US011168439B1

(12) United States Patent
Toll et al.

(10) Patent No.: US 11,168,439 B1
(45) Date of Patent: Nov. 9, 2021

(54) HANDHELD STEAM IRON

(71) Applicant: NORI Inc., New Canaan, CT (US)

(72) Inventors: Courtney Toll, New Canaan, CT (US); Mohan Rajasekaran, Bristol, CT (US)

(73) Assignee: NORI INC., New Canaan, CT (US)

( * ) Notice: Subject to any disclaimer, the term of this patent is extended or adjusted under 35 U.S.C. 154(b) by 38 days.

(21) Appl. No.: 16/897,897

(22) Filed: Jun. 10, 2020

(51) Int. Cl.

| | |
|---|---|
| ***D06F 75/14*** | (2006.01) |
| ***D06F 75/30*** | (2006.01) |
| ***D06F 75/34*** | (2006.01) |
| ***D06F 71/02*** | (2006.01) |
| ***D06F 71/34*** | (2006.01) |
| ***D06F 71/36*** | (2006.01) |

(52) U.S. Cl.
CPC ..... *D06F 75/14* (2013.01); *D06F 71/02* (2013.01); *D06F 71/34* (2013.01); *D06F 71/36* (2013.01); *D06F 75/30* (2013.01); *D06F 75/34* (2013.01)

(58) Field of Classification Search
CPC ..... D06F 75/00; D06F 75/35; D06F 71/02; D06F 71/34; D06F 71/36; A45D 1/00; A45D 1/02; A45D 1/04; A45D 1/06; A45D 1/08; H05B 3/22
See application file for complete search history.

(56) References Cited

U.S. PATENT DOCUMENTS

| | | | | |
|---|---|---|---|---|
| 3,577,859 | A * | 5/1971 | Davidson | D06F 75/30 38/71 |
| 3,949,499 | A * | 4/1976 | Schaeffer | D06F 75/14 38/77.3 |
| 6,494,216 | B1 * | 12/2002 | Hirata | A45D 1/04 132/224 |
| 7,121,024 | B1 | 10/2006 | Clevenberg | |
| 7,380,556 | B2 * | 6/2008 | Carballada | A45D 1/04 132/224 |
| 8,276,297 | B2 | 10/2012 | Fabrikant | |
| 8,375,610 | B2 | 2/2013 | Bearley | |
| 9,181,651 | B2 | 11/2015 | Bishop | |
| 9,528,220 | B2 * | 12/2016 | Dierker | D06F 75/30 |
| 2004/0000319 | A1 | 1/2004 | Carballada et al. | |
| 2008/0072921 | A1 * | 3/2008 | Habibi | A45D 2/002 132/224 |

(Continued)

FOREIGN PATENT DOCUMENTS

| | | | |
|---|---|---|---|
| GB | 2512953 | A | 10/2014 |

OTHER PUBLICATIONS

International Search Report and Written Opinion dated Jun. 4, 2021 issued in PCT Application No. PCT/US21/23686.

*Primary Examiner* — Ismael Izaguirre
(74) *Attorney, Agent, or Firm* — Troutman Pepper Hamilton Sanders LLP; Christopher C. Close, Jr.; Brandon M. Reed

(57) ABSTRACT

A handheld steam iron for straightening creases in wrinkled fabric is disclosed. The handheld steam iron can combine the benefits of both an iron and a steamer by providing heat and steam to a garment. The handheld steam iron can include an upper arm and a lower body. The upper arm and lower body can include a plate, steam channels, or both. The steam iron can include one or more pumps to provide water to the upper arm and/or lower body so that both sides of the steam iron receive equal amounts of steam. The steam iron can also include a removable liquid reservoir that enables a user to quickly replace the liquid provided for steam.

20 Claims, 11 Drawing Sheets

(56) References Cited

U.S. PATENT DOCUMENTS

| | | | | |
|---|---|---|---|---|
| 2010/0180908 | A1* | 7/2010 | Leung | A45D 2/001<br>132/223 |
| 2010/0199528 | A1 | 8/2010 | Fabrikant | |
| 2012/0102793 | A1 | 5/2012 | Harrington | |
| 2013/0152434 | A1 | 6/2013 | Bearley | |
| 2019/0350335 | A1* | 11/2019 | Montagnino | A45D 20/12 |

* cited by examiner

HANDHELD STEAM IRON

FIELD OF THE DISCLOSURE

Examples of the present disclosure generally relate to clothing steam irons and, more particularly, to handheld steam irons with fluid pumps and removable fluid reservoirs.

BACKGROUND

Wrinkled clothing is a problem that any consumer has spent a great deal of time remediating. To alleviate the ever-persistent problem, consumers generally choose between two common wrinkle-removing implements: the iron or the steamer. The iron is a cumbersome artifact that tends to provide more problems than solutions. For example, a user wishing to iron a garment must retrieve not only the large appliance, but must also retrieve an ironing board or, alternatively, find a flat surface when an ironing board is unavailable. Also, the user must find the appropriate space to store both the iron and corresponding ironing board.

The steamer is another large and cumbersome appliance that requires a significant amount of storage space. Although the steamer has the advantage of not requiring a solid surface to remove wrinkles, it does generally require a water source, which is not always readily available. When a water source is available, steamers can often make the garment wet instead of removing wrinkles in the fabric. Therefore, neither of the most popular wrinkle-removing platforms are optimal when considering the additional resources required, the storage space required, and the inevitable drawbacks of the designs. These problems are only exacerbated for consumers wishing to travel with their wrinkle-removing implement.

What is needed, therefore, is a system for removing wrinkles from garments without needing a flat surface to press upon. The system could ideally provide heat and/or steam to both sides of the garment to improve the ironing experience. In some examples, the system could ideally enable a user to create steam even if there is no water tap available.

SUMMARY

Aspects of the present disclosure are directed to these needs. In particular, aspects of the present disclosure involve a wrinkle-removing device that combines the beneficial attributes of both an iron and a steamer, while also remediating the inherit design flaws of the iron and the steamer. Examples of the present disclosure can include an elongated, flat iron design that is both ergonomic, space-saving, and effective at removing wrinkles from garments.

Aspects of the present disclosure relate to a handheld steam iron that provides heat for ironing garments. The handheld steam iron can be designed for clamping clothing between an upper arm and a lower body. The upper arm can hinge up from the lower body in a manner to allow the garment to be inserted between the far end of the upper arm and the far end of the lower body. In some examples, the handheld steam iron can include two plates, one plate on the underside of the upper arm and one plate on the top side of the lower body. The plates can be heated by heating elements placed adjacent to the respective plates. Some examples can include an option to set the temperature of the plates to a temperature desirable for a particular fabric. For example, a user can select a temperature on the handheld steam iron by selecting from a preset fabric temperature setting, such as settings for linen, denim, cotton, wool, silk, polyester, or any other desired fabric. Other examples can allow the user to select a determined temperature, such as temperatures from 200° F. to 500° F., at 5° F. increments or any other increment. Any other range or increment is also possible.

In some examples, the steam iron of the present disclosure provides steam to the garment. For example, the upper arm can include a steam chamber positioned proximate the upper plate so that the user can provide steam to the garment once the garment is clamped between the upper arm and lower body. Conversely, or in addition, the lower body can include a lower steam chamber. The respective plates and steam chambers can be heated independently, for example, by including one or more heating elements dedicated to heating the plates (e.g., upper plate heating element and lower plate heating element) and one or more heating elements dedicated to heating the steam chambers (e.g., upper steam heating element and lower steam heating element).

In some examples, the steam iron can include a fluid reservoir that can be inserted into a housing in either the upper arm or lower body. A pump can draw fluid, such as water, from the reservoir and supply the fluid to the steam chambers. The pump can be a dual-pump such that fluid is supplied to the upper steam chamber independently of the lower steam chamber. This can ensure an intended amount of fluid is supplied to the steam chambers regardless of the position or orientation of the steam iron.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
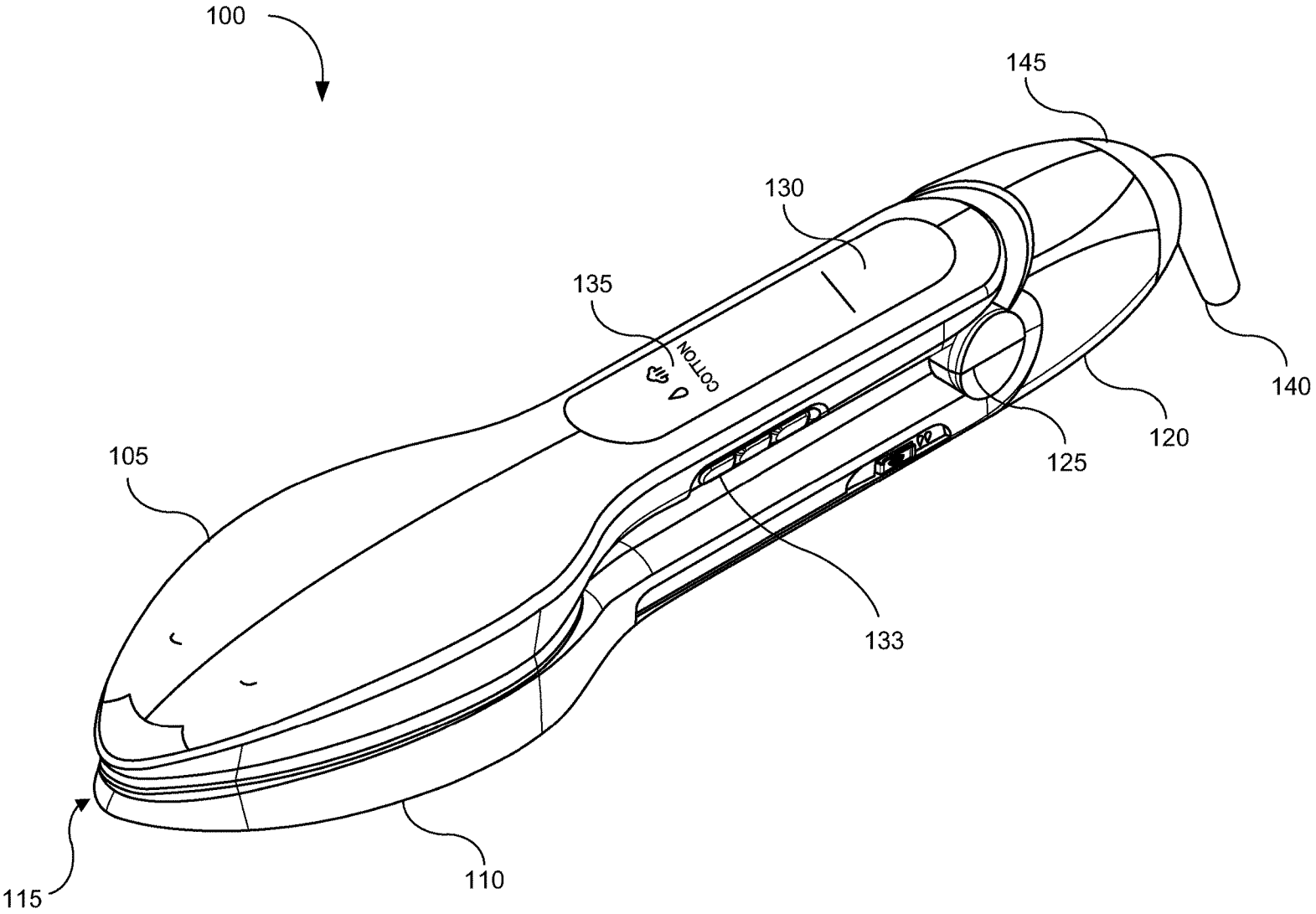
FIG. 1 is an example handheld steam iron with an upper arm and a lower body, according to some examples of the present disclosure.

Although certain examples of the disclosure are explained in detail, it is to be understood that other examples are contemplated. Accordingly, it is not intended that the disclosure is limited in its scope to the details of construction and arrangement of components set forth in the following description or illustrated in the drawings. Other examples of the disclosure are capable of being practiced or carried out in various ways. Also, in describing the examples, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It also is to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

To facilitate an understanding of the principles and features of the disclosure, various illustrative embodiments are explained below. In particular, the presently disclosed subject matter is described in the context of being a handheld steam iron. The present disclosure, however, is not so limited, and can be applicable in other contexts. For example, and not limitation, some examples of the present disclosure can improve other heating and straightening systems, such as hair straighteners and curlers, heat presses, portable fabric cleaners, decal presses, and decal removers. These examples are contemplated within the scope of the present disclosure. Accordingly, when the present disclosure is described in the context of garment wrinkle releasing systems, such as a handheld steam iron, it will be understood that other examples can take the place of those referred to.

As discussed above, existing options for removing wrinkles from clothes have disadvantages. An iron provides the wrinkle-releasing benefits of supplying a flat heat source to a garment, but the iron requires substantial storage space. The iron also requires a flat surface to function properly, which potentially means the customer must also store an ironing board. The iron is further limited because it can only heat one surface at a time. A steamer provides wrinkle-releasing benefits by slightly dampening a garment, thereby removing any creases, but the steamer has many of the iron's disadvantages. Additionally, steamers can wet the garment more than is necessary to effectively remove wrinkles. Steamers also require access to a water supply. As will be appreciated, the disadvantages of these common solutions make them especially impractical for travel.

Examples of the presently disclosed technology alleviate such disadvantages by, for example, combining the benefits of both an iron and a steamer into a single design. In particular, the present disclosure includes various examples of a handheld steam iron that improve upon conventional irons. For example, the handheld steam iron includes an upper arm and a lower body having plates that can be heated. As will be appreciated, the heating and smoothing properties can, therefore, be applied to both sides of the garment at the same time, unlike the traditional iron.

In other aspects, the handheld steam iron provides benefits found in a clothes steamer. In particular, the upper arm and/or lower body can include a steam chamber. Additionally, the handheld steam iron can provide benefits over a traditional steamer by enclosing a removable, replaceable fluid reservoir within the casing of the device. For example, the fluid reservoir can be located within the housing of the upper arm or within the housing of the lower body. As will be appreciated, the handheld steam iron of the present disclosure provides benefits that a steamer cannot provide. The replaceable fluid reservoir can provide benefits not normally offered by existing market solutions, including providing a pre-measured amount of fluid to produce steam, providing added scent, and reducing potential harm that can come with pouring water into an electrical device. A handheld steam iron according to the present disclosure can provide steam from a steam chamber in the upper arm and/or lower body, and can provide heat from an upper plate and/or lower plate, thus combining the benefits of both a steamer and an iron.

Referring now to the figures, wherein like reference numerals represent like parts throughout the views, exemplary embodiments will be described in detail. FIG. 1 is an example handheld steam iron 100 with an upper arm 105 and a lower body 110, according to some examples of the present disclosure. In some examples, a handheld steam iron 100 can be an elongated form with a tip 115 at a distal end and a heel 120 at a proximal end As will be appreciated, a heel 120 can provide additional grip beyond the surface of the upper arm 105.

Figure 2:
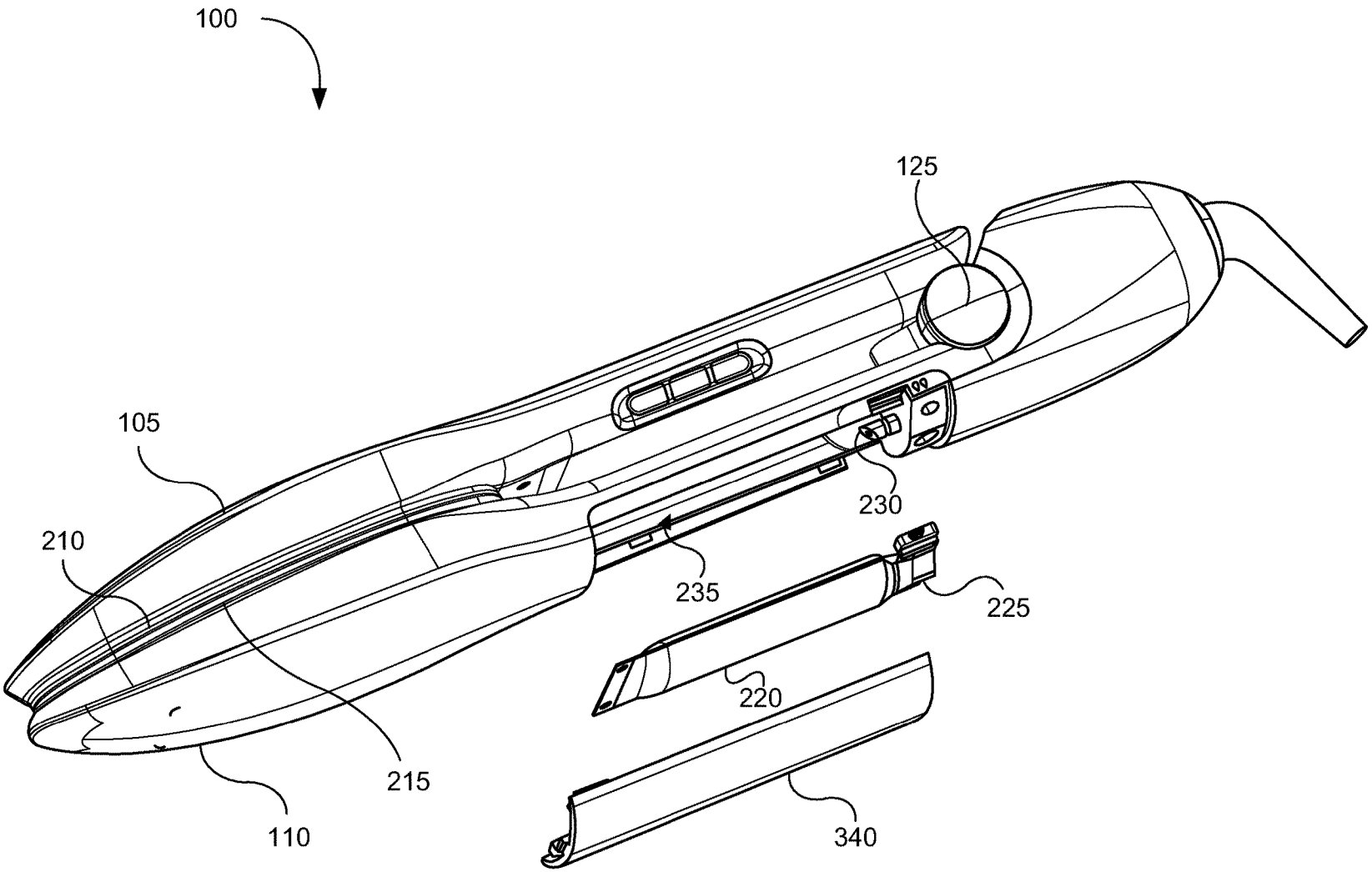
FIG. 2 is a partially-exploded perspective view of a handheld steam iron, according to some examples of the present disclosure.

The upper arm 105 can be attached to the lower body 110 at a hinge 125 (i.e., the upper arm 105 can be hingeably connected to the lower body 110). The hinge 125 can connect the upper arm 105 to the lower body 110. In some examples, the hinge 125 can include a pre-loaded torsion spring that automatically facilitates moving the upper arm 105 and lower body 110 into a closed position and creates a compressive force between the upper plate 210 and the lower plate 215 (as shown in FIG. 2). In other words, the hinge 125 can be biased into a closed configuration to facilitate the closing of the upper plate 210 and lower plate 215 onto the garment. Alternatively, the hinge 125 can be pre-loaded, or biased, into an open configuration. This can facilitate the opening of the plates to insert the garment. It is contemplated that the hinge 125 does not include a torsion spring, and the upper arm 105 can hinge freely with respect to the lower body 110.

In some examples, the hinge 125 can, in addition to or as an alternative to opening and closing the upper arm 105 and lower body 110, separate the upper arm 105 and lower body 110 proximate the hinge 125. For example, if a garment of considerable thickness is introduced into the garment insertion end 325, the hinge 125 can separate, or widen, to raise the upper plate 210 to remain parallel to the lower plate 215.

In some examples, a handheld steam iron 100 can include a button 130, which can activate any number of functions. For example, and not limitation, a button 130 can be used to turn on the handheld steam iron 100. The button 130 can also activate heat provided to the upper plate 210 and/or lower plate 215 or activate steam provided by steam chambers (which will be described in greater detail below). The button 130 can be a mechanical push button, a capacitive touch sensor, a resistive touch sensor, and/or the like.

The handheld steam iron 100 can include a temperature-selecting display 135 that can be positioned on any surface of the device. For example, and not limitation, a temperature-selecting display 135 can be placed on the top surface of the upper arm 105. In some examples, a temperature-selecting display 135 can identify settings that correspond to different fabric settings, and the settings can be illuminated when a user selects the corresponding temperature setting. The readout can be an LED display or any other display capable of displaying a temperature setting. A temperature-selecting display 135 can be pre-programmed to adjust to a particular temperature when a user selects a particular fabric. Example pre-programmed temperatures for fabrics include, but are not limited to, the temperatures listed in Table 1 below. In other examples, a temperature-selecting display 135 can include a readout displaying an exact temperature. For example, a user can select a desired temperature within a given temperature range and at pre-set temperature increments (e.g., a user can select a temperature of from 200° F. to 500° F., and in 5° F. increments or any other increment). The button 130 can be used to change the handheld steam iron 100 to different temperature settings. For example, a long press on the button 130 can activate the heat and/or steam, while short presses on the button 130 can cycle through the temperature settings. In other examples, the handheld steam iron 100 can include temperature-selection buttons 133 that are dedicated to changing the temperature setting of the device.

TABLE 1

Exemplary Fabric Temperature Settings

| Fabric | Temperature (° F.) |
|---|---|
| Linen | 445 |
| Cotton | 400 |
| Triacetate | 390 |
| Viscose | 375 |
| Wool | 300 |
| Polyester | 300 |
| Silk | 300 |
| Acetate | 290 |
| Acrylic | 275 |
| Lycra/Spandex | 275 |
| Nylon | 275 |

FIG. 2 is a partially-exploded perspective view of a handheld steam iron 100, according to some examples of the present disclosure. The handheld steam iron 100 can include an upper plate 210 on the underside of the upper arm 105. The upper plate 210 can be heated such that the upper plate 210 releases wrinkles by heating a garment's fabric. The handheld steam iron 100 can include a lower plate 215 on the upper side of the lower body 110 that can also provide heat to release wrinkles. The handheld steam iron 100 can also include steam channels (e.g., steam channels 410 and 505 described with reference to FIG. 5) that can provide steam through the upper plate 210 and/or lower plate 215. The present device is not required to have two plates, however. For example, some handheld steam irons 100 according to the present disclosure can include only a single plate, e.g., one of the upper plate 210 or the lower plate 215.

The upper plate 210 and the lower plate 215 can include materials configured for high-temperature ironing including, but not limited to, aluminum, stainless steel, ceramics, titanium, and any other material or combination of materials that can maintain stiffness at high temperatures. In some examples, the upper plate 210 and/or the lower plate 215 can include a first material (i.e., an inner material) that is coated with a second, different material configured to improve the smoothness of the plates. Materials configured to improve the smoothness of the plates include, but are not limited to, ceramics, Teflon, or any other material that can withstand high temperatures.

The handheld steam iron 100 can include a removable fluid reservoir 220. The removable fluid reservoir 220 can be positioned in the upper arm 105 or lower body 110 and provide the fluid (e.g., water or another fluid) for steam. In some examples, the removable fluid reservoir 220 can be pre-loaded with a fluid, such that a consumer can purchase reservoirs for use in the handheld steam iron 100. The removable fluid reservoir 220 can also include perfumes, oils, or other fluids that can provide scent to the fabric. In some examples, the removable fluid reservoir 220 can be refillable. In this example, a consumer can fill the removable fluid reservoir 220 with water, use the water in the reservoir, and then refill the removable fluid reservoir 220 when empty. The removable fluid reservoir 220 provides a benefit to the user when there is no access to a water source. For example, when the user is traveling, previous designs for steam irons would require the user to find a water source or purchase a bottle of water. With the present design, the user can grab a removable fluid reservoir 220, insert it into the handheld steam iron 100, and remove wrinkles regardless of whether there is a water source nearby. Furthermore, the removable fluid reservoir 220 can provide a pre-measured amount of liquid so the user does not need to guess how much water is necessary to create steam, as can be the case with existing irons and steamers.

The removable fluid reservoir 220 can be a flexible pouch made of a plastic, foil, or other material. In some examples, the removable fluid reservoir 220 can include a valve 225 that prevents the fluid in the reservoir from exiting the removable fluid reservoir 220 unless the removable fluid reservoir 220 is inserted into the handheld steam iron 100. An example of this includes a one-way silicon valve. The handheld steam iron 100 can include a puncture tip 230 that can be inserted into the valve 225 to access the fluid within the removable fluid reservoir 220. Other valve systems can include the male/female connector, where one of the connectors is included within a cover and the other connector is included within a reservoir housing, as described below with reference to FIGS. 6A and 6B.

The removable fluid reservoir 220 can be housed within a reservoir housing 235 sized to contain the removable fluid reservoir 220. The reservoir housing 235 can be positioned within the upper arm 105 or lower body 110. Once the removable fluid reservoir 220 is inserted into the reservoir housing 235, a cover 340 can be placed over the reservoir housing 235 to enclose the removable fluid reservoir 220 within the handheld steam iron 100. This would be similar to the cover for batteries on the back of a remote control. This example is described in greater detail with reference to FIG. 5 below. In another example, the removable fluid reservoir 220 can be connected to the cover 340 before the removable fluid reservoir 220 is inserted into the reservoir housing 235. In this example, the cover 340 can act as a carriage for the removable fluid reservoir 220. This example is described in greater detail with reference to FIGS. 6A and 6B below.

Figure 3A:
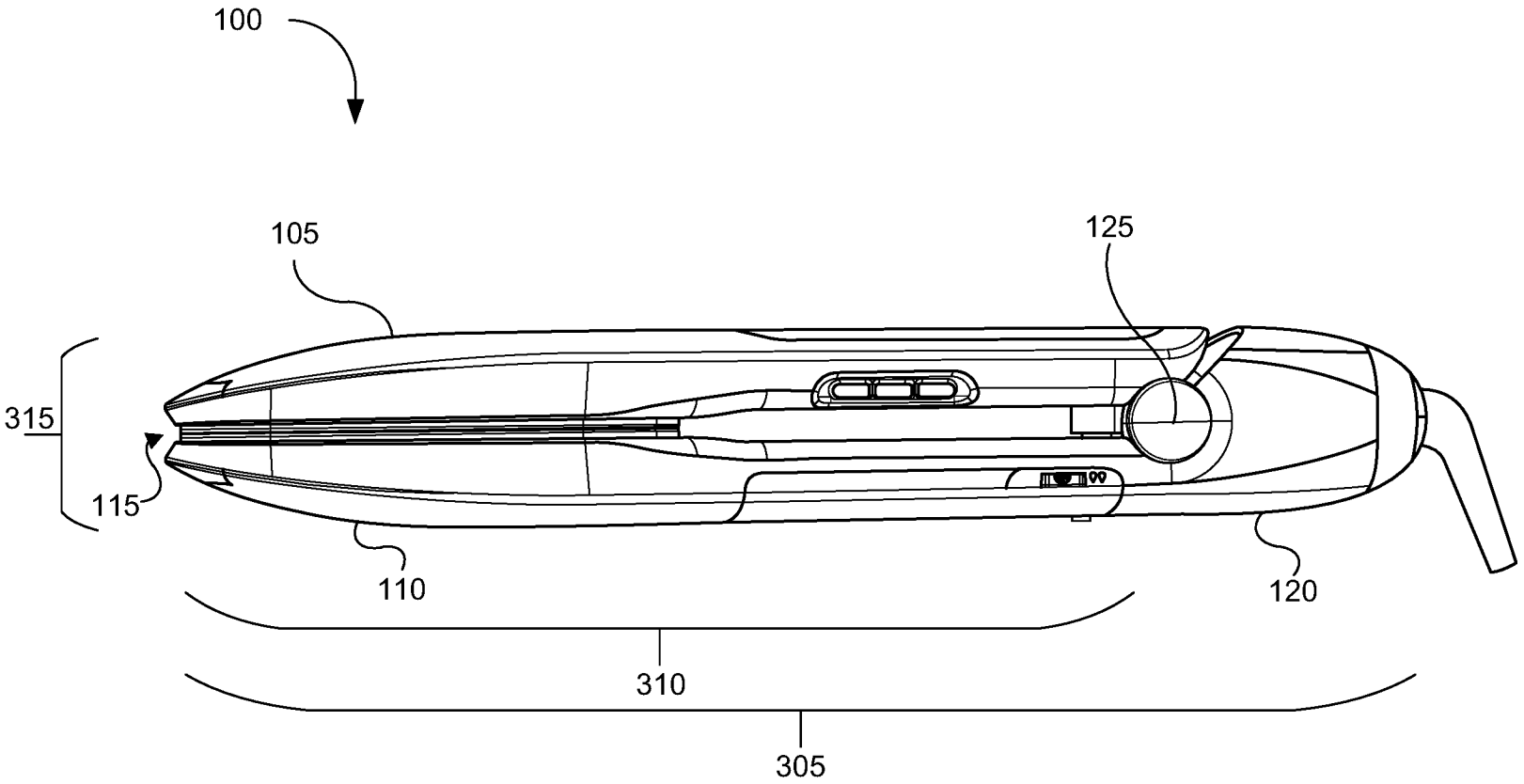
FIGS. 3A and 3B are side views of an example handheld steam iron, according to some examples of the present disclosure.
Figure 3B:
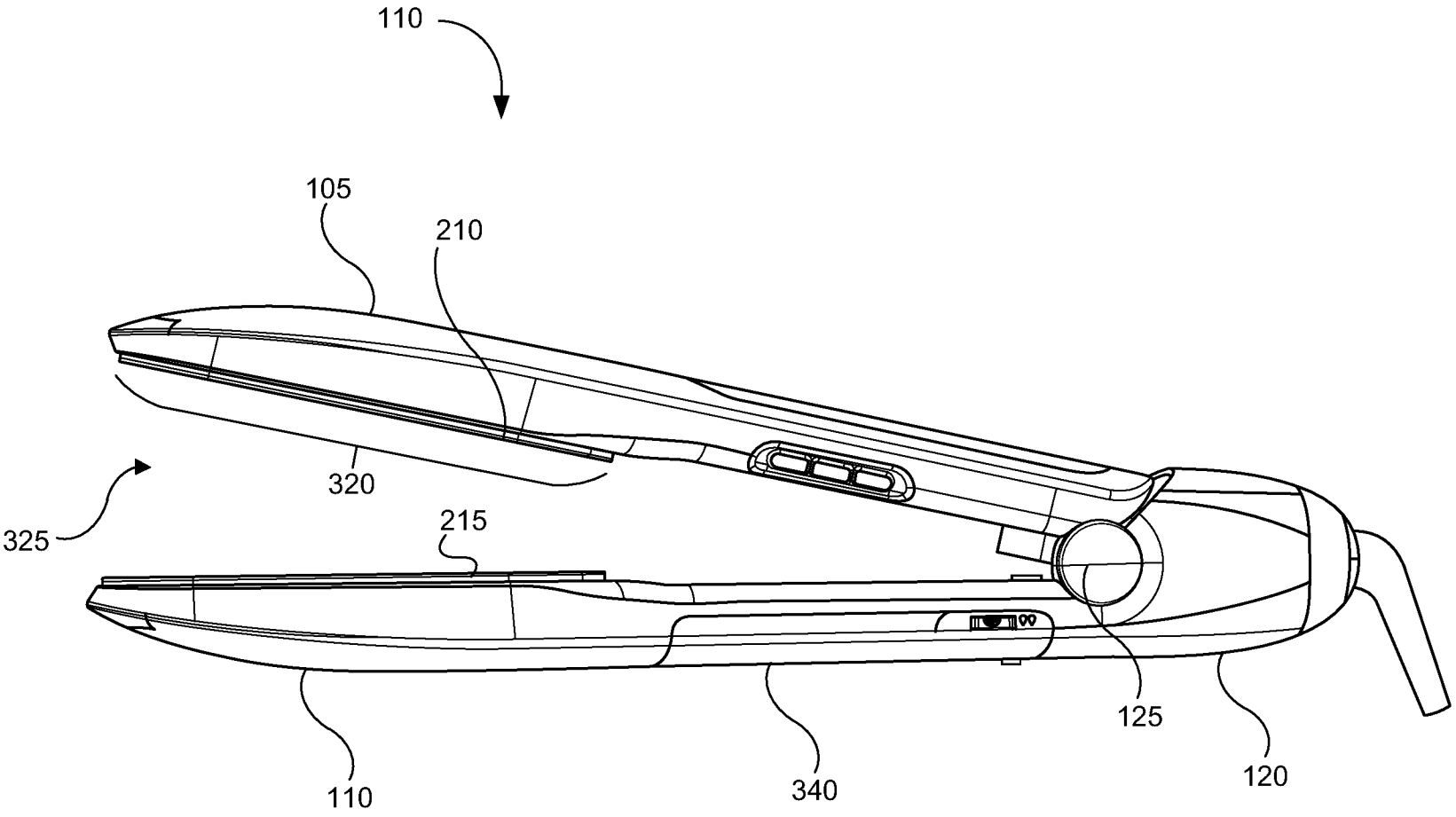

FIGS. 3A and 3B are side views of an example handheld steam iron 100, according to some examples of the present disclosure. FIG. 3A shows a handheld steam iron 100 in a closed, or clamped, configuration; FIG. 3B shows a handheld steam iron 100 in an open configuration such that a garment can be placed between the upper plate 210 and lower plate 215. A handheld steam iron 100 can have a total length 305 configured to provide various desired traits for a steam iron. For example, the total length 305 can be short so as to make the device more compact; the total length 305 can be long so as to allow greater coverage over a garment. In some examples, the total length 305 can be from 12-24 inches. It is conceived, however, that the total length 305 can be longer or shorter than this range.

A handheld steam iron 100 can have a clamping length 310 extending from the tip 115 of the iron to the hinge 125. When a user inserts garments between the upper arm 105 and the lower body 110, the clamping length 310 can provide the length of coverage across the garment. A cross section of an average shirt, for example, can be approximately 22 inches from one side to the opposite side. Therefore, from a center point on the average shirt in the coronal plane, an average shirt can extend approximately 11 inches to one side and 11 inches to the other side. Accordingly, a handheld steam iron 100 can have a clamping length 310 to cover at least one half of the width of an average shirt, thereby allowing a user to smooth one half the width of the shirt in one passing and another one half the width of the shirt on a second passing. Accordingly, the clamping length 310 can be from 7 inches to 14 inches, or any other length.

The clamping length 310 may not extend the total length 305 of the handheld steam iron 100 because, in some examples, the upper arm 105 can be positioned along the lower body 110 distal to the heel 120. In other words, the hinge 125 can be placed distal to the heel 120, and the heel 120 can provide an area for the user to grip the handheld steam iron 100 such that the user is not required to grab the iron only around the lower body 110 and upper arm 105. This can help facilitate the opening and closing of the handheld steam iron 100. In other examples, the handheld steam iron 100 may not include a heel 120, and the hinge 125 can be placed at the proximal end of the device.

In some examples, the handheld steam iron 100 can have a maximum width (now shown in side view), which can be configured to provide various desired traits for a steam iron. For example, the total maximum width can be narrow so as to make the device more compact; the maximum width can be wide so as to allow greater coverage over a garment. The maximum width can be, for example, from 1 inch to 5 inches. The average distance between two buttons on the front of an average button-down shirt can be between 3.5 inches and 4 inches. In some examples, the maximum width can accommodate this distance and be from 2 inches to 4 inches. Although the design considerations of the distance between two buttons on a button-down shirt may be of interest when designing a handheld steam iron 100, the design considerations are not limitations on the maximum width for a handheld steam iron 100.

The handheld steam iron 100 can have a clamping thickness 315, which can be dimensioned to provide various desired traits for a steam iron. For example, the clamping thickness 315 can be small so as to make the device more compact; the clamping thickness 315 can be large so as to provide greater structural integrity. It is conceived that the clamping thickness 315 can be from ½ inch to 3 inches.

A handheld steam iron 100 can have a plate length 320, which is a length of the upper plate 210 and/or the lower plate 215. The plate length 320 may be configured to provide various desired traits for a steam iron. For example, a longer plate length 320 can cover more surface area on a single pass of the device; a shorter plate length 320 can provide a more compact size. In some examples, the plate length 320 can be sufficient to cover the 11-inch coverage-area described in detail above. The maximum length of a plate length 320 can be the same as the clamping length 310, e.g., from 7 inches to 14 inches. In some examples, the plate length 320 may be shorter than the clamping length 310, as shown in FIGS. 3A and 3B, for example from 2 inches to 7 inches. The upper plate 210 and/or lower plate 215 can have maximum widths equal to the maximum width described above for the upper arm 105 and/or lower body 110, for example widths of from 1 inch to 5 inches.

FIG. 3B shows an example open configuration for a handheld steam iron 100. The view shows how the upper arm 105 can hinge from the lower body 110 at a position distal to the heel 120. This, again, can provide the user a place to grip the handheld steam iron 100. The handheld steam iron 100 can have an insertion end 325 positioned between the upper plate 210 and/or lower plate 215 when the iron is in an open configuration. When a handheld steam iron 100 is in an open configuration, a user can place a garment or portion of the garment between the upper arm 105 and the lower body 110.

Figure 4A:
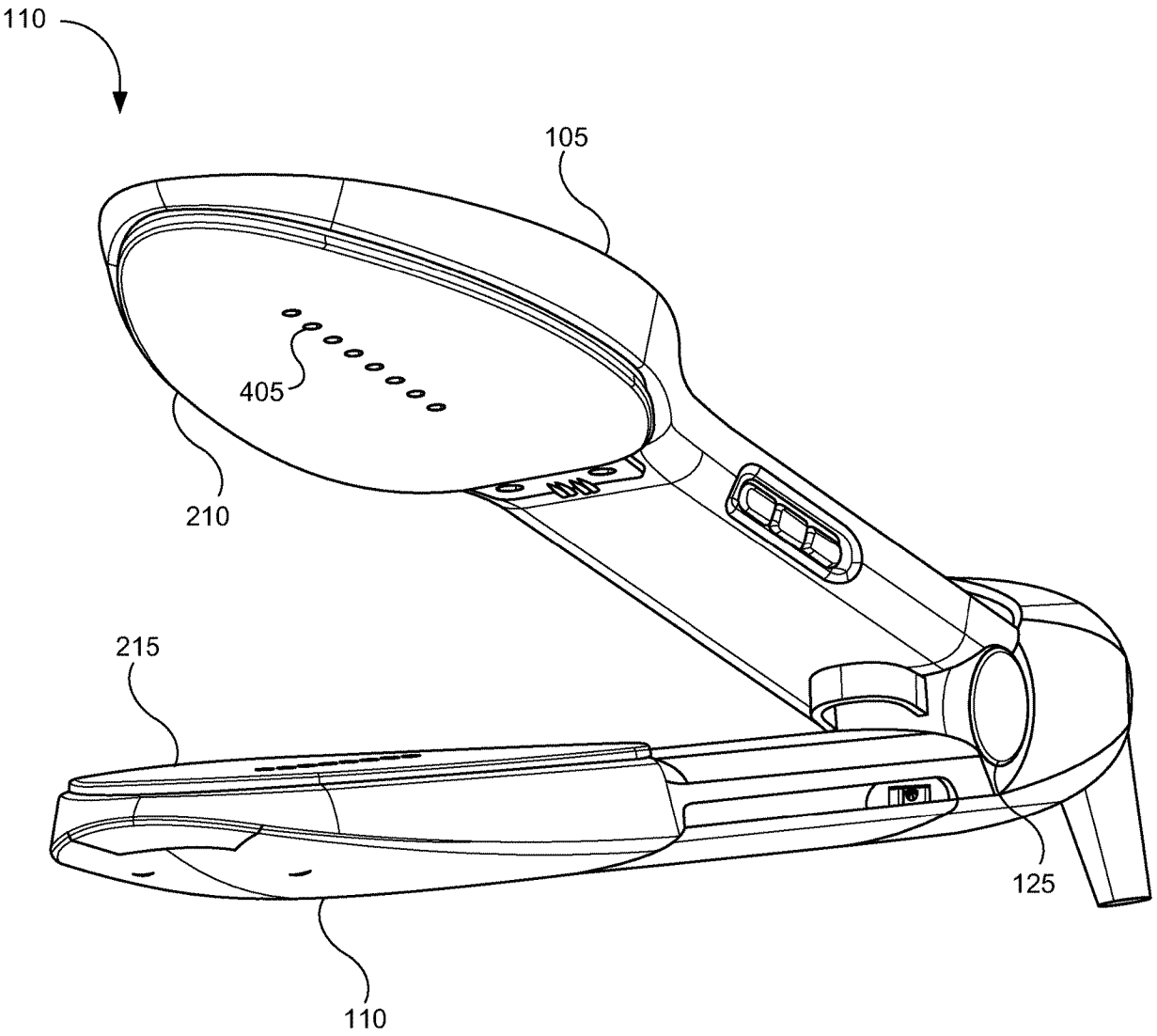
FIG. 4A is a perspective view of a handheld steam iron in an open configuration, according to some examples of the present disclosure.

FIG. 4A is a perspective view of a handheld steam iron 100 in an open configuration, according to some examples of the present disclosure. The upper plate 210 and/or lower plate 215 can include steam holes 405 for enabling steam to reach the garment. A steam hole 405 may be defined by any desired shape to provide steam to a garment. For example, a steam hole 405 can be circular, oval, square, or any other defined shape. A steam hole 405 can also be elongated, such that a steam channel traverses a plate from one end of the plate to another end. As will be described below, a steam channel can be placed adjacent to the upper plate 210 and/or lower plate 215 to provide the steam through the steam holes 405.

Figure 4B:
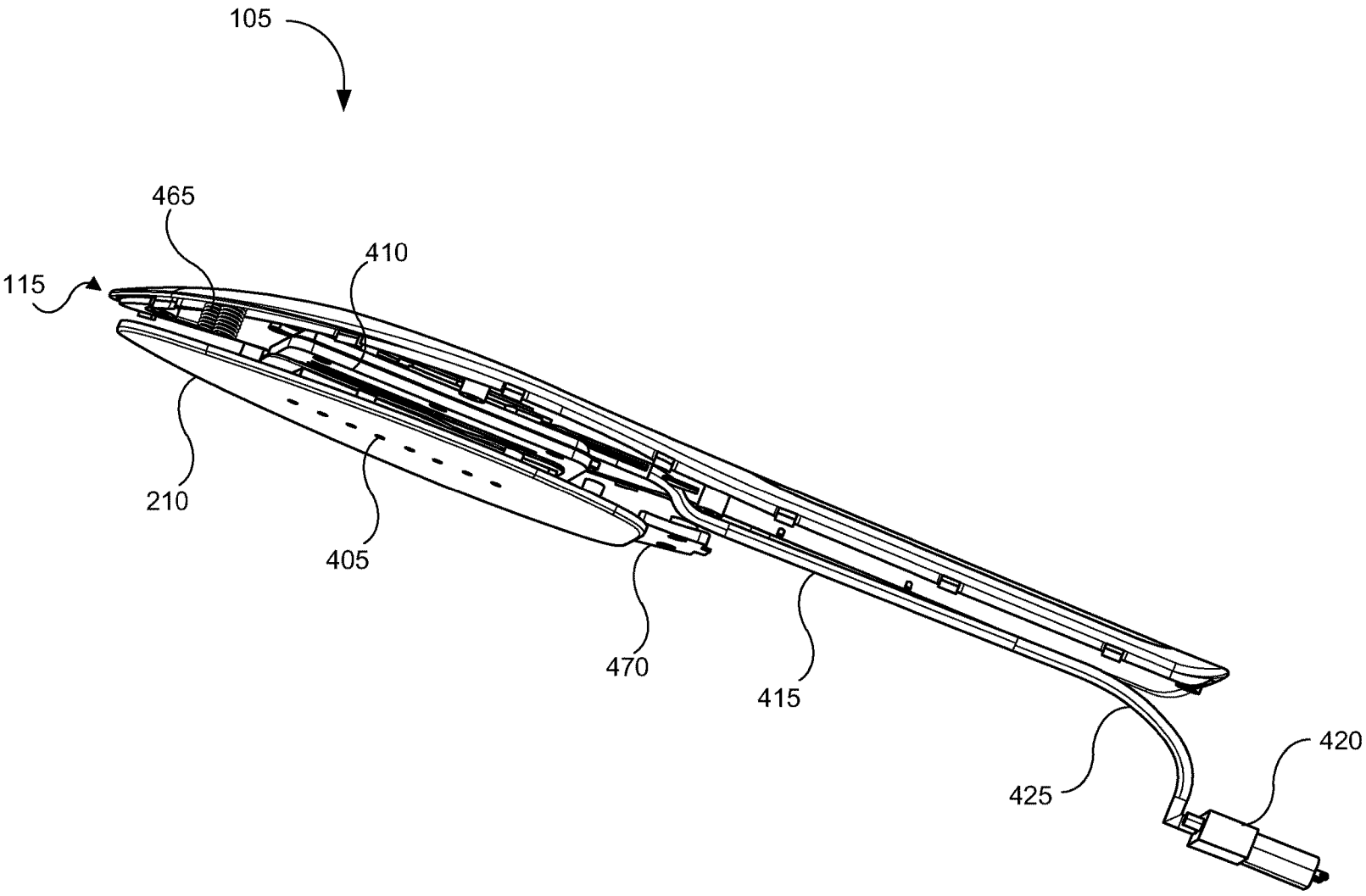
FIG. 4B is a cutaway view of an example upper arm without an outer housing, according to some examples of the present disclosure.

FIG. 4B is a cutaway view of an example upper arm 105 without an outer housing, according to some examples of the present disclosure. The figure shows example internal components of the upper arm 105. Any of the components described with reference to the upper arm 105 can be present in the lower body 110; providing only a view of the upper arm 105 enables an unobstructed view of the internal components.

The upper arm 105 can include an upper steam chamber 410 that can heat fluid provided to the steam chamber 410 by an upper conduit 415. By providing a steam chamber 410 that is separate from the upper plate 210, the fluid can be heated by the upper steam chamber 410 instead of the upper plate 210. This can ensure the fluid is fully vaporized prior to the fluid reaching the upper plate 210 and exiting the steam holes 405; the heat provided by the upper plate 210 can be used specifically to heat the garment to remove wrinkles. Having an upper steam chamber 410 separate from the upper plate 210, therefore, can prevent the fluid from leaking out of the steam holes 405 and onto the garment. The upper steam chamber 410 can include a plurality of inner channels that serpentine through the seam chamber 410 to fully vaporize the fluid before it exits the upper steam chamber 410.

The upper conduit 415 can connect the upper steam chamber 410 to a pump 420. As will be described below, the pump 420 can draw fluid from the removable fluid reservoir 220 and supply the fluid to the upper steam chamber 410 (and lower steam chamber if present). The pump 420 can be disposed within the lower body 110 (e.g., in the heel 120) or in the upper arm 105. The upper conduit 415 can include a flexible portion 425. As will be appreciated, if the pump 420 and the removable fluid reservoir 220 are disposed within the lower body 110, at least a portion of the upper conduit 415 can be flexible to enable the upper arm 105 to open and close.

Figure 4C:
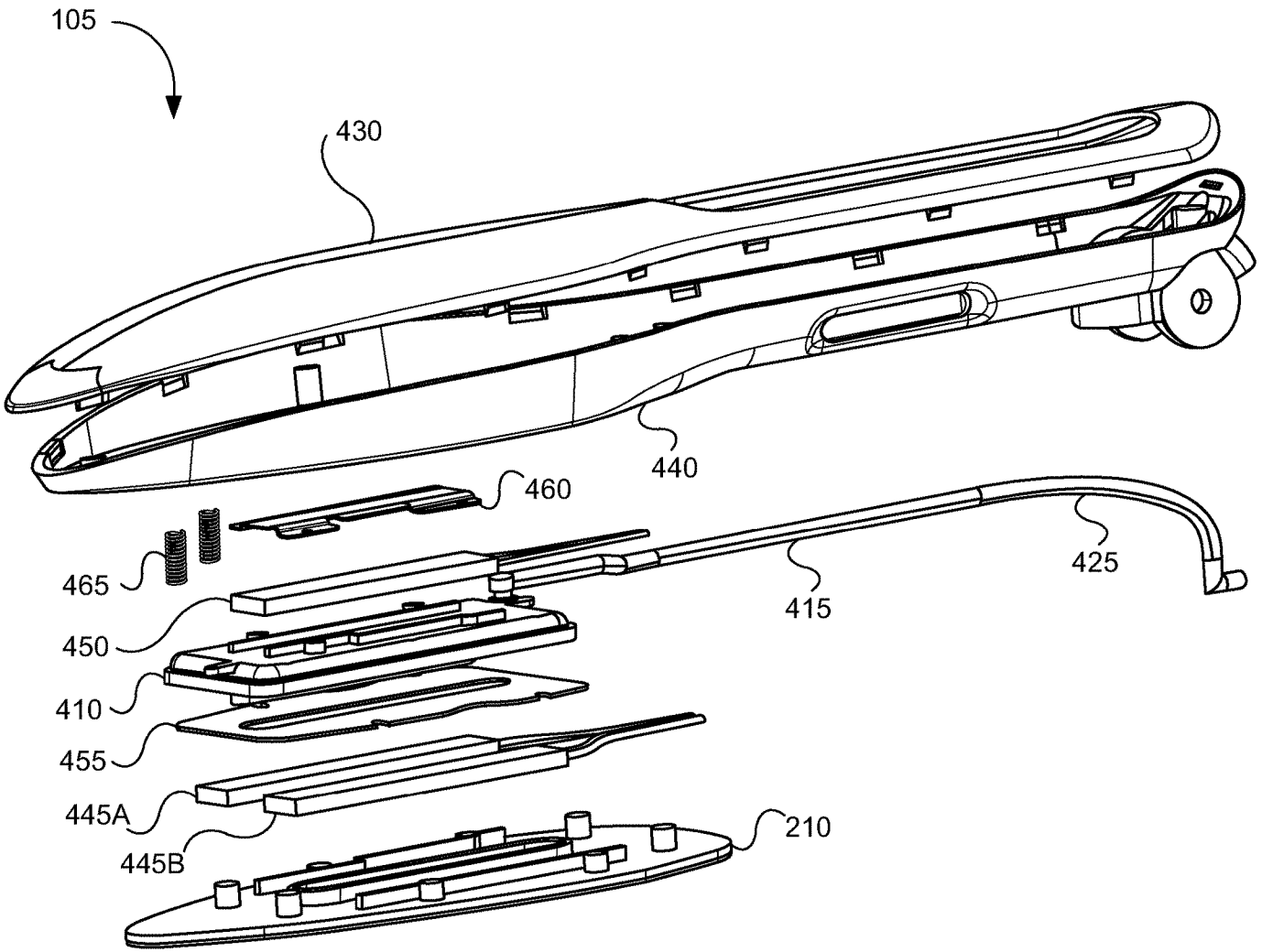
FIG. 4C is an exploded view of an example upper arm, according to some examples of the present disclosure.

FIG. 4C is an exploded view of an example upper arm 105, according to some examples of the present disclosure. Again, although only the upper arm 105 is shown, any of the components described with reference to the upper arm 105 can be present in the lower body 110. The upper arm 105 can include a cover housing 430 and a body housing 440 to enclose the various components within the upper arm 105.

The upper arm 105 can have one or more upper-heating plate elements 445A,445B positioned proximate the upper plate 210. The upper-heating plate elements 445A,445B can be dedicated to heat the upper plate 210 to remove the wrinkles. The upper-heating plate elements 445A,445B can include electric heating elements, for example resistance wire or other metallic heating elements, ceramic heating elements, and/or the like.

The upper arm 105 can have one or more upper steam heating elements 450 positioned proximate the upper steam chamber 410. As described above, the steam chambers and plates described herein can have separate, dedicated heating elements so that one set of elements (e.g., the upper steam heating elements 450) can be used for heating the steam chamber and one set of elements (e.g., the upper-heating plate elements 445A,445B) can be used for heating the plate. This can ensure the fluid from the upper conduit 415 is properly heated to steam without needing to use the heat from the plate to vaporize the fluid. The upper-heating plate elements 445A,445B and the upper steam chamber 410 can be separated by a first plate 455. The first plate 455 can be insulative so that the upper steam chamber 410 is heated only by the upper steam heating elements 450 and not the upper-heating plate elements 445A,445B. The upper steam heating elements 450 can be attached to the upper steam chamber 410 by a bracket 460.

As will be appreciated, the upper plate 210 can be in a fixed position, such that the plate remains rigid when pressure is applied to any portion of the surface of the plate (i.e., the surface of the plate that would be in contact with a garment). In other examples, the upper plate 210 can be configured to enable a pivoting or flexing action such that, when pressure is applied to any portion of the surface, the upper plate 210 will readjust position. For example, when a user inserts a garment of nonuniform thickness between the upper plate 210 and the lower plate 215, the upper plate 210 and/or lower plate can pivot (or "flex") to enable the plates to maintain more uniform contact with the garment. The upper arm 105 can have one or more springs 465 that enable the upper plate 210 to flex. The springs 465 can be positioned at the distal tip 115 of the upper arm 105 (or lower body 110). At the other end of the plate 210/215, the upper arm 105 and/or lower body 110 can abut a flange 470. The plates 210/215, for example, can float upon the flange 470 such that the plates 210/215 are pivotal with respect to the flange 470. The plates 210/215 can be biased toward the springs 465 such that the plates 210/215 raise and lower (i.e., axially) more at the distal end of the device than at the end proximate the flange 470. Instead of a flange, additional springs can be placed at the opposite end of the plates than the distal springs 465.

Figure 5:
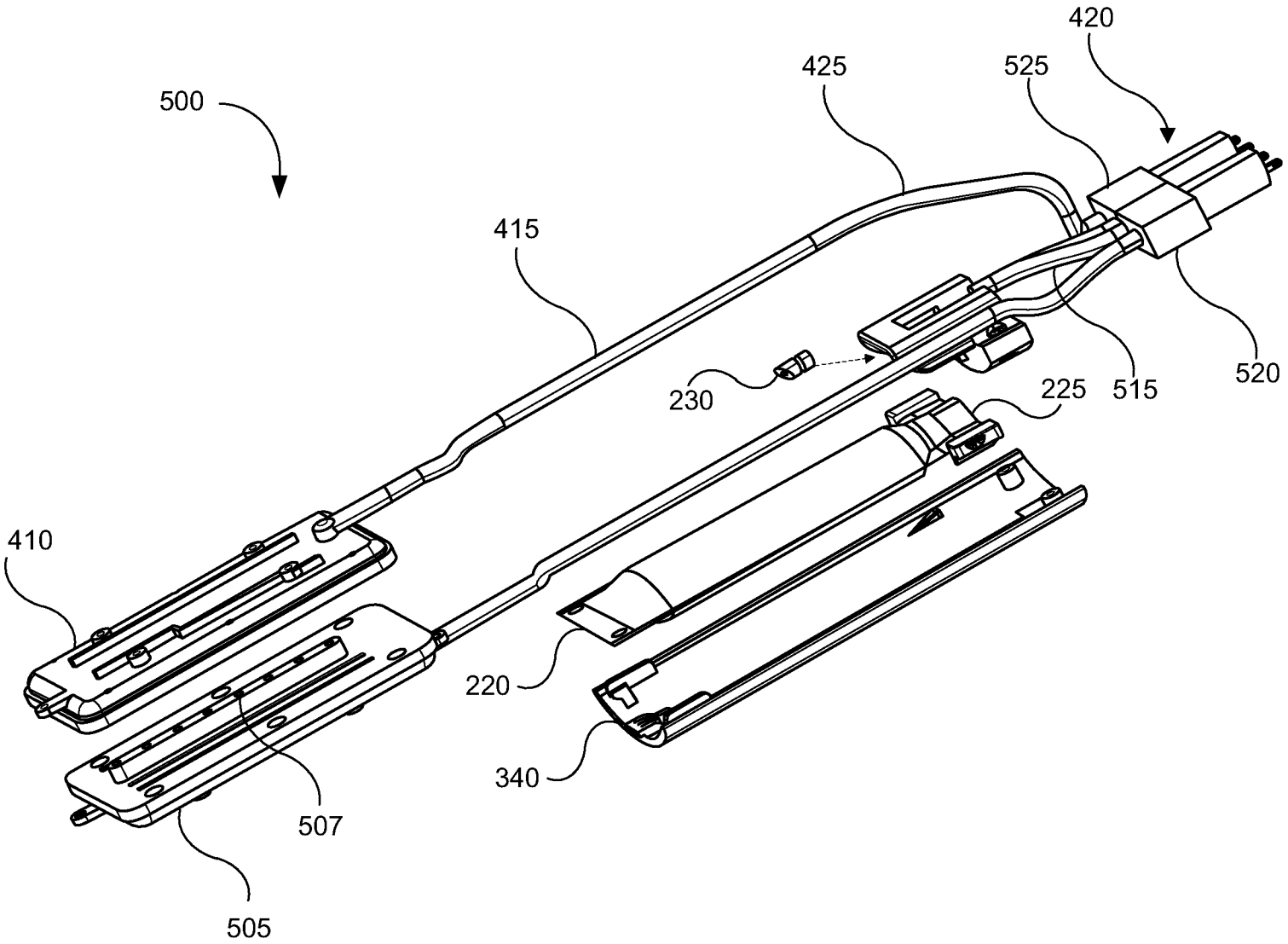
FIG. 5 is a perspective view of an example inner steam system for a handheld steam iron, according to some examples of the present disclosure.

FIG. 5 is a perspective view of an example inner steam system 500 for a handheld steam iron 100, according to some examples of the present disclosure. As described above, the upper steam chamber 410 can be fluidly connected to the pump 420 via an upper conduit 415. The inner steam system 500 shown in FIG. 5 also provides a view of an example lower steam chamber 505 fluidly connected to the pump 420 via a lower conduit 510, which can be similar to the upper conduit 415. The upper steam chamber 410 and/or lower steam chamber 505 can include steam outlets 507 that enable the steam created by the chambers to exit the chamber and pass through the plates (e.g., via steam holes 405).

The handheld steam iron 100 can include an inlet conduit 515 for drawing fluid from the removable fluid reservoir 220. As shown in FIG. 5, the puncture tip 230 described above can be positioned at the end of the inlet conduit 515. The puncture tip 230 can be inserted into the valve 225 of the removable fluid reservoir 220 to pierce the valve 225 and access the fluid within the reservoir. In this example, once the removable fluid reservoir 220 is inserted into the reservoir housing 235, the valve 225 of the removable fluid reservoir 220 can be pierced, and the removable fluid reservoir 220 can then be covered by the cover 340.

Figure 6A:
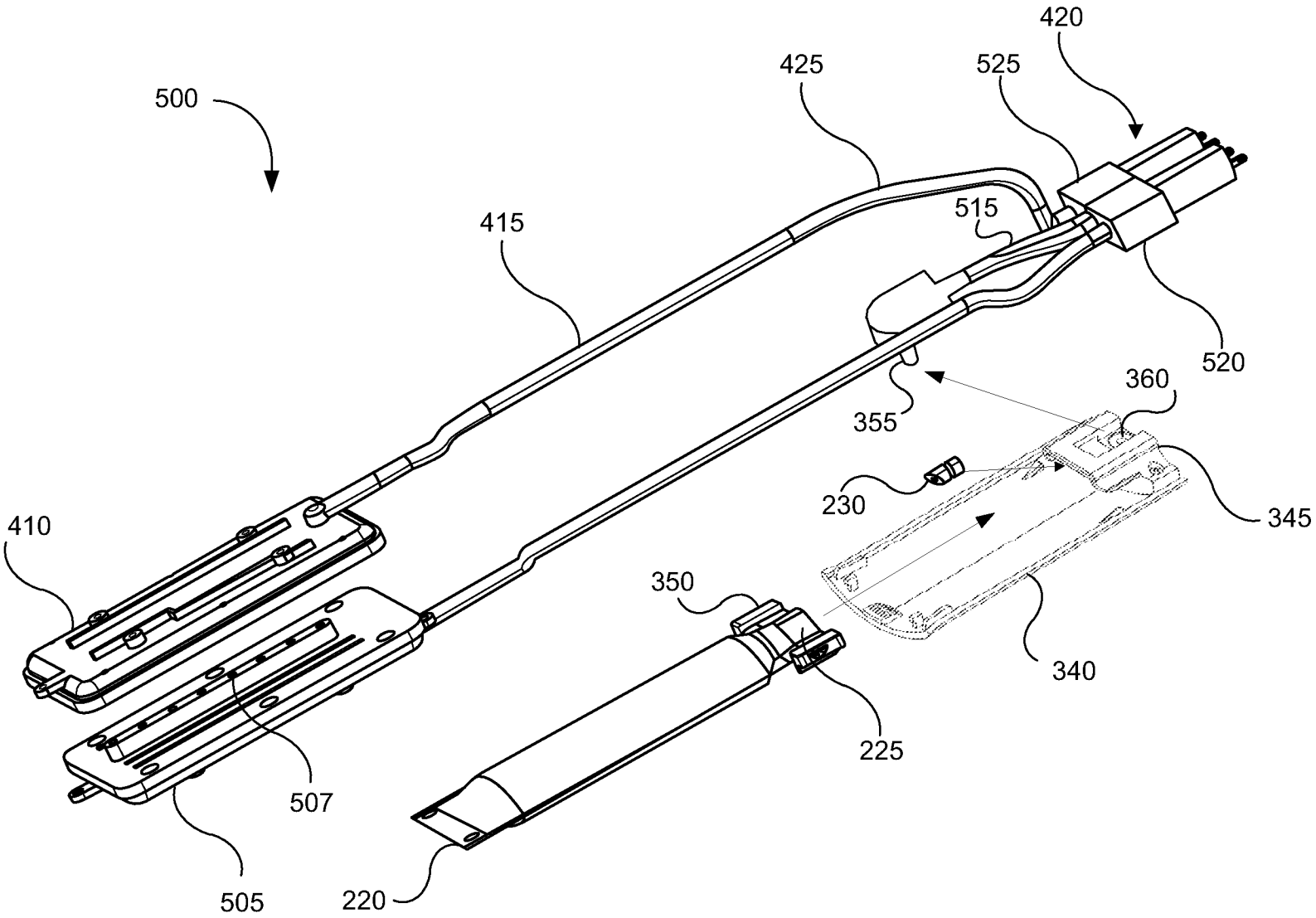
FIGS. 6A and 6B are perspective views of an example removable fluid reservoir attachable to a cover, according to some examples of the present disclosure.

FIG. 6A shows a different valve system that can be employed to cause the fluid from the fluid reservoir to enter the inlet conduit 515. As described above, the removable fluid reservoir 220 can be connected to the cover 340 before the removable fluid reservoir 220 is inserted into the reservoir housing 235. The cover 340 can include a connector 345 that captures the upper valve-portion (i.e., near valve 225) of the removable fluid reservoir 220. The removable fluid reservoir 220 can also include wings 350 proximate the valve 225 that can be sized to engage with the connector 345 to secure the removable fluid reservoir 220 to the cover 340. The connector 345 can include the puncture tip 230 described above. Once the removable fluid reservoir 220 is connected to the connector 345, the removable fluid reservoir 220/cover 340 assembly can be docked onto the reservoir housing 235. A housing port 355 in fluid communication with the inlet conduit 515 can connect with a cover port 360 on the cover 340. The cover port 360 can be in direct fluid communication with the puncture tip 230. The housing port 355 and cover port 360, once connected, can create a fluid path between the puncture tip 230 (and thus the valve 225 of the removable fluid reservoir 220) and the inlet conduit 515. The housing port 355 can be a male-end connector and the cover port 360 can be a female-end connector, and vice versa.

Figure 6B:
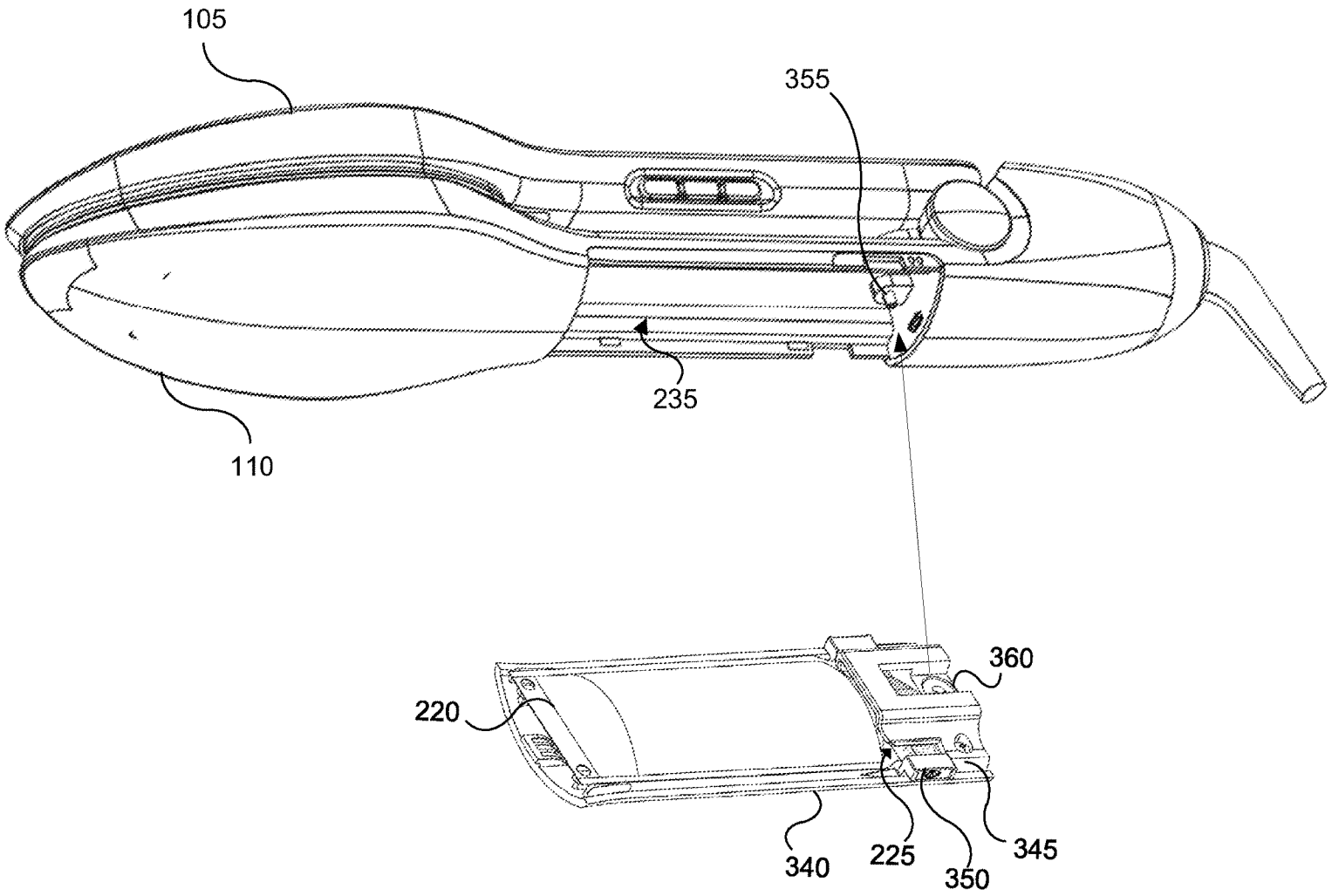

FIG. 6B is a perspective view of a handheld steam with a removable fluid reservoir 220 attachable to the cover 340, as described with reference to FIG. 6A. The view in FIG. 6B is similar to the view in FIG. 2 but includes a cover 340 that acts as a carriage for the removable fluid reservoir 220. This view also shows the housing port 355 positioned within the reservoir housing 235. Once the removable fluid reservoir 220 is connected to the cover 340, for example via the connector 345, the reservoir/cover assembly can be positioned at the reservoir housing 235. The cover port 360 on the cover 340 can then connect with the housing port 355 to create the fluid path between the removable fluid reservoir 220 and the inlet conduit 515.

Referring again to FIG. 5, the pump 420 that draws the fluid from the removable fluid reservoir 220 can be a single pump, such that fluid can be drawn from the removable fluid reservoir 220 via the inlet conduit 515 and then pumped concurrently through the upper conduit 415 and the lower conduit 510 to the respective steam chambers. In other examples, the pump 420 can be a dual pump comprising a first sub-pump 520 and a second sub-pump 525. The dual pump 420 can draw fluid from the inlet conduit 515, which can be shared between the first sub-pump 520 and the second sub-pump 525. After drawing the fluid, the first sub-pump 520 can independently supply fluid to the lower steam chamber 505; and the second sub-pump 525 can independently supply fluid to the upper steam chamber 410 (or vice versa). Providing an independent fluid supply to both the upper steam chamber 410 and the lower steam chamber 505 can ensure an intended amount of fluid is supplied to the steam chambers regardless of the position or orientation of the handheld steam iron 100. For example, if the pump 420 is a single pump, gravity may cause more fluid to be supplied to the lower steam chamber 505 if it is positioned by the user toward the bottom of the handheld steam iron 100. The dual-pump design can correct this by providing a specific and intended amount of fluid to both steam chambers.

Referring again to the example in FIG. 1, the handheld steam iron 100 can include a power cord 140 disposed proximate a rear tip 145. In some examples, the power cord 140 can connect to another position on the heel 120. The power cord 140 can rotate at the point where the power cord 140 connects to the device. For example, a power cord 140 can rotate 360 degrees within the device, allowing the user to move the device more freely. In some examples, the power cord 140 can rotate within any other range between 0 and 360 degrees, though the cord 140 can also be static such that it does not rotate within the device.

In some examples, a handheld steam iron 100 can include an internal battery. A battery can be housed at any position within the lower body 110 or the upper arm 105. Examples of a handheld steam iron 100 having a battery can also include a charging apparatus. The charging apparatus can be located at the rear tip 145 of the device, at another position on the heel 120, or at any other location.

Figure 7:
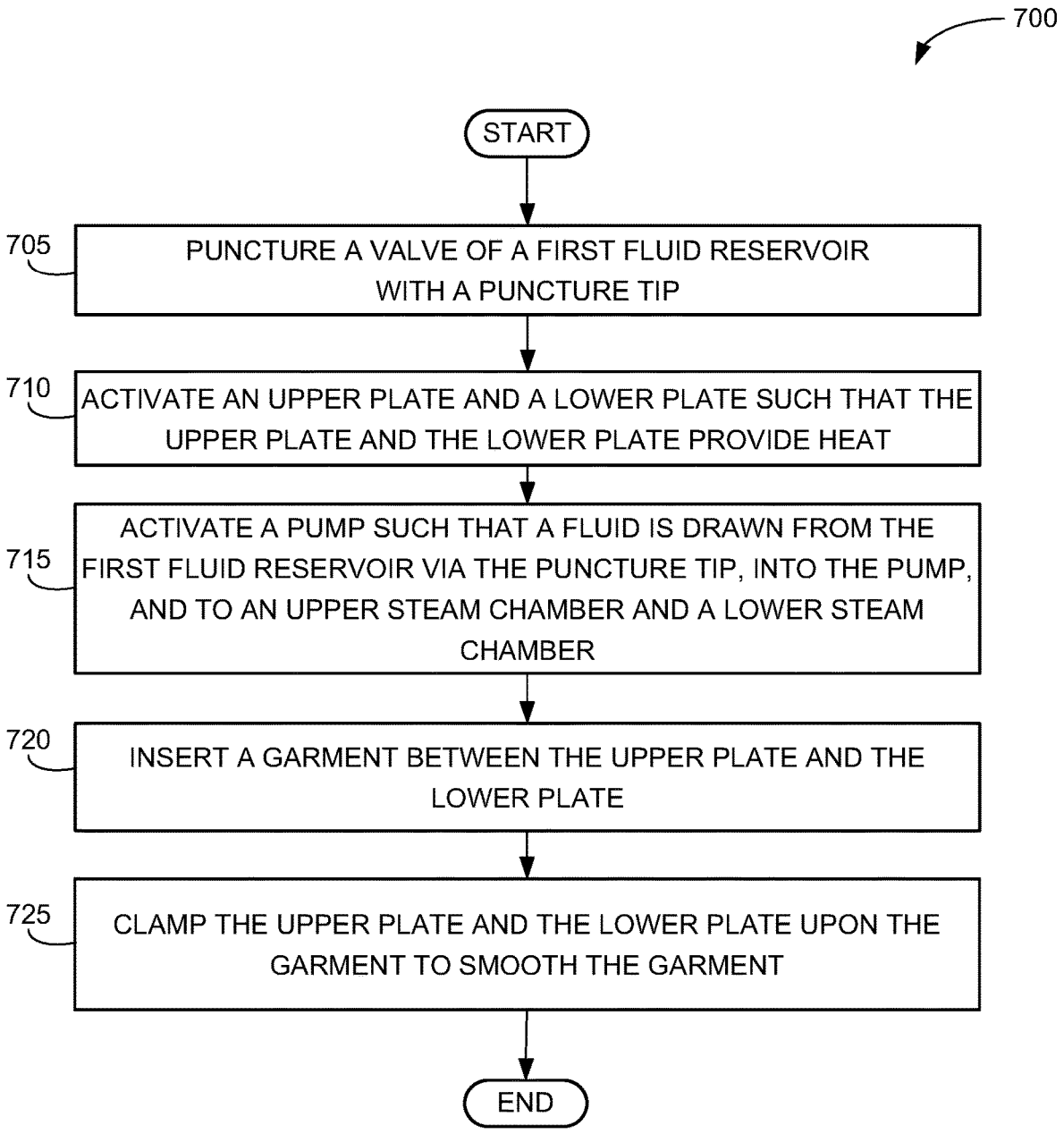
FIG. 7 is a flowchart showing an example method for operating a handheld steam iron, according to some examples of the present disclosure.

FIG. 7 is a flowchart showing an example method 700 for operating a handheld steam iron, according to some examples of the present disclosure. Method 700 can be performed using the example handheld steam irons 100 described above. Method 700 can begin at block 705, which includes puncturing a valve of the first fluid reservoir with a puncture tip. After the valve is punctured, an inlet conduit of the steam iron can draw fluid, such as water, from the reservoir.

The puncture tip can be positioned at various locations, as described above. In some examples, the puncture tip can be positioned within a reservoir housing that is placed in the upper arm or lower body. Once the first fluid reservoir is inserted into the reservoir housing, the valve can be punctured, and a cover can be placed over the reservoir housing. In other examples, the puncture tip can be positioned within the cover, and the first fluid reservoir can be connected to the cover concurrently with the puncture tip puncturing the valve. Once connected, the reservoir/cover assembly can be inserted into the reservoir housing. A port within the housing can be aligned with a port on the cover to provide fluid flow between the first fluid reservoir and the inlet conduit.

At block 710, method 700 includes activating an upper plate and a lower plate such that the upper plate and the lower plate provide heat. This can be accomplished, for example, by activating a button on the iron. The button can both provide heat and, in some examples, cycle through different temperature settings. At block 715, method 700 includes activating a pump such that a fluid is drawn from the first fluid reservoir via the puncture tip, into the pump, and to an upper steam chamber and a lower steam chamber.

At block 720, method 700 includes inserting a garment between the upper plate and the lower plate. At block 725, method 700 can include clamping the upper plate and the lower plate upon the garment to smooth the garment.

Method 700 can end after block 725. In other examples, additional steps can be performed according to the examples described herein. The first fluid reservoir can be removed from the handheld steam iron, for example, and a second fluid reservoir can be inserted. In some examples, the first fluid reservoir can be removed from the handheld stem iron, refilled, and reinserted into the handheld steam iron.

What is claimed is:

1. A handheld steam iron comprising:

a lower body comprising:
- a lower plate;
- a lower-plate heating element adjacent to the lower plate; and
- a lower steam chamber;

an upper arm having a proximal end hingeably connected to the lower body and comprising:
- an upper plate;
- an upper-plate heating element adjacent to the upper plate; and
- an upper steam chamber;

a removable fluid reservoir; and a pump in fluid communication with the removable fluid reservoir, the lower steam chamber, and the upper steam chamber.

2. The handheld steam iron of claim 1, further comprising a lower steam heating element adjacent to the lower steam chamber.

3. The handheld steam iron of claim 2, further comprising an upper steam heating element adjacent to the upper steam chamber.

4. The handheld steam iron of claim 1, further comprising a reservoir housing disposed within the lower body sized to contain the removable fluid reservoir.

5. The handheld steam iron of claim 4, further comprising:
a cover sized to cover the reservoir housing and comprising:
a puncture tip sized to puncture a valve of the removable fluid reservoir; and
a cover port in fluid communication with the puncture tip; and
an inlet conduit having a first end and a second end, the first end in fluid communication with the cover port and the second end in fluid communication with the pump.

6. The handheld steam iron of claim 1, wherein:
the pump is a dual pump comprising a first sub-pump and a second sub-pump; and
the handheld steam iron further comprises:
an upper conduit in fluid communication with the first sub-pump and the upper steam chamber; and
a lower conduit in fluid communication with the second sub-pump and the lower steam chamber.

7. The handheld steam iron of claim 1, wherein:
a distal end of the lower body is proximate the lower plate;
a proximal end of the lower body comprises a heel; and
the upper arm is connected to the lower body distal to the heel.

8. The handheld steam iron of claim 1, further comprising:
a first spring positioned at a first end of the lower plate;
a first flange positioned at a second end of the lower plate;
a second spring positioned at a first end of the upper plate; and
a second flange positioned at a second end of the upper plate,
wherein the lower plate is movable and is biased toward the first spring, and
wherein the upper plate is movable and is biased toward the second spring.

9. The handheld steam iron of claim 1, wherein the upper arm is hingeably connected to the lower body by a hinge biased into an open configuration.

10. The handheld steam iron of claim 1, wherein the removable fluid reservoir is refillable.

11. A handheld steam iron comprising:
a lower body comprising a lower plate configured to be heated by a lower-plate heating element;
an upper arm hingeably connected to the lower body and comprising an upper plate configured to be heated by an upper-plate heating element;
a lower steam chamber adjacent to the lower body;
an upper steam chamber adjacent to the upper arm;
a fluid reservoir; and
a dual-pump comprising a first sub-pump and a second sub-pump, wherein:
the first sub-pump is configured to draw a fluid from the fluid reservoir and provide the fluid to the lower steam chamber; and
the second sub-pump is configured to draw the fluid from the fluid reservoir and provide the fluid to the upper steam chamber.

12. The handheld steam iron of claim 11, further comprising:
a lower steam heating element adjacent to the lower steam chamber; and
an upper steam heating element adjacent to the upper steam chamber.

13. The handheld steam iron of claim 11, further comprising a reservoir housing disposed within the lower body sized to enclose the fluid reservoir, wherein the fluid reservoir is configured to be inserted into and removed from the reservoir housing.

14. The handheld steam iron of claim 13, further comprising:
a cover sized to cover the reservoir housing and comprising:
a puncture tip sized puncture a valve of the fluid reservoir; and
a cover port in fluid communication with the puncture tip; and
an inlet conduit having a first end and a second end, the first end in fluid communication with the cover port and the second end in fluid communication with the dual-pump.

15. The handheld steam iron of claim 11, wherein:
a distal end of the lower body is proximate the lower plate;
a proximal end of the lower body comprises a heel; and
the upper arm is connected to the lower body distal to the heel.

16. The handheld steam iron of claim 11, further comprising:
a first spring positioned at a first end of the lower plate;
a first flange positioned at a second end of the lower plate;
a second spring positioned at a first end of the upper plate; and
a second flange positioned at a second end of the upper plate,
wherein the lower plate is movable and is biased toward the first spring, and
wherein the upper plate is movable and is biased toward the second spring.

17. The handheld steam iron of claim 11, wherein the upper arm is hingeably connected to the lower body by a hinge biased into an open configuration.

18. A method for operating a handheld steam iron, the method comprising:
puncturing a valve of a first fluid reservoir with a puncture tip;
activating an upper plate and a lower plate such that the upper plate and the lower plate provide heat;
activating a pump such that a fluid is drawn from the first fluid reservoir via the puncture tip, into the pump, and to an upper steam chamber and a lower steam chamber;
inserting a garment between the upper plate and the lower plate; and
clamping the upper plate and the lower plate upon the garment to smooth the garment.

19. The method of claim 18, wherein:
the puncture tip is disposed within a cover; and
the method further comprises:
connecting the first fluid reservoir to a connector on the cover;
positioning the cover within a reservoir housing of the handheld steam iron; and
aligning a housing port within the reservoir housing with a cover port on the cover, the housing port being in fluid communication with the pump and the cover port being in fluid communication with the first fluid reservoir.

20. The method of claim 19, further comprising:

disconnecting the first fluid reservoir from the connector; and connecting a second fluid reservoir to the connector.

* * * * *